US010186182B2

(12) United States Patent
Wang et al.

(10) Patent No.: US 10,186,182 B2
(45) Date of Patent: Jan. 22, 2019

(54) ADAPTER DEVICE FOR TEXT, TERMINAL TEST SYSTEM AND TEST METHOD

(71) Applicant: BOE TECHNOLOGY GROUP CO., LTD., Beijing (CN)

(72) Inventors: Lei Wang, Beijing (CN); Xiaopeng Liu, Beijing (CN); Yanjiao Pan, Beijing (CN); Shufen Song, Beijing (CN); Shengfei Ma, Beijing (CN); Peng Xie, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 15/788,929

(22) Filed: Oct. 20, 2017

(65) Prior Publication Data

US 2018/0277030 A1 Sep. 27, 2018

(30) Foreign Application Priority Data

Mar. 23, 2017 (CN) ..... 2017 1 0178630

(51) Int. Cl.
*G09G 3/00* (2006.01)
*G09G 3/20* (2006.01)

(52) U.S. Cl.
CPC ..... *G09G 3/006* (2013.01); *G09G 3/2092* (2013.01); *G09G 2330/021* (2013.01)

(58) Field of Classification Search
CPC . G09G 3/006; G09G 3/2092; G09G 2330/021
See application file for complete search history.

(56) References Cited

U.S. PATENT DOCUMENTS 7,573,286 B2 * 8/2009 Huelson ..... G09G 3/006 324/760.01
7,924,043 B2 * 4/2011 Schroth ..... G01R 31/3183 324/750.01
8,810,268 B2 * 8/2014 Huang ..... G09G 3/006 324/750.3
9,437,145 B2 * 9/2016 Han ..... G09G 3/3696

* cited by examiner

*Primary Examiner* — Abhishek Sarma
(74) *Attorney, Agent, or Firm* — Calfee, Halter & Griswold LLP

(57) ABSTRACT

An adapter device for test, including: an adapter board having a voltage input terminal connected to an external power supply and an output terminal connected to a terminal to be tested; a voltage conversion circuit disposed on the adapter board and connected to the voltage input terminal and configured to convert the voltage of the external power supply received at the voltage input terminal into a test voltage to be supplied to the terminal to be tested; a feedback circuit connected to the voltage conversion circuit and configured to compare the test voltage with a reference voltage to provide feedback data; and a compensation circuit connected to the feedback circuit and the adapter board, and configured to generate a compensation voltage based on the feedback data and apply the compensation voltage to the adapter board to compensate for the test voltage.

7 Claims, 4 Drawing Sheets

ADAPTER DEVICE FOR TEXT, TERMINAL TEST SYSTEM AND TEST METHOD

CROSS-REFERENCE TO RELATED APPLICATIONS

The present application claims priority to Chinese Patent Application No. 201710178630.1, filed Mar. 23, 2017, titled "ADAPTER DEVICE FOR TEST, TERMINAL TEST SYSTEM AND TEST METHOD", the entire contents of which are incorporated herein by reference.

TECHNICAL FIELD

The present disclosure relates to the field of display technology, and more particularly, to an adapter device for test, a terminal test system and a test method.

BACKGROUND

With the development of optical technology and semiconductor technology, flat panel displays such as liquid crystal display (LCD) and organic light Emitting Diode (OLED) have the advantages of lightness, low energy consumption, fast response speed and good color purity, high contrast and other characteristics, and occupy a dominant position in the display field.

In order to ensure the display quality, the display device will be tested at the factory, to test the electrical performance of the device product through screen lighting test. For example, through an external power supply, a 3.3V voltage is applied to the display screen as a logic input voltage VDD of a printed circuit board (PCB), to test the display effect.

During the test, it is required to ensure that the logic input voltage VDD is constant. However, when the displayed frame is switched, since load from the display screen is changed while the voltage of the external power supply is constant, the current will change, which inevitably results in change of the logic input voltage VDD. Since the external power supply voltage is converted to 3.3V by an adapter board, and then supplied to the PCB as the logic input voltage VDD, and during the conversion, the adapter board and an adapter cable will inevitably consume a part of the voltage, the logic input voltage VDD actually supplied to the PCB will be lower than 3.3V. Moreover, with the switching of the displayed frame, the heavier the load of the frame is, the greater the voltage drop will occur on the adapter board and the adapter cable, and thus the lower the logic input voltage VDD to the PCB will be.

In the related art, each time the displayed frame is switched, it is necessary to connect the test point of the logic input voltage VDD with a multimeter, and at the meantime, manually adjust the voltage of the external power supply such that the logic input voltage VDD remains constant, which results in significant inconvenience for the screen lighting test.

It is to be noted that the information disclosed in the above-mentioned background section is for the purpose of reinforcing the understanding of the background of the present disclosure and may therefore include information that does not constitute related art known to those of ordinary skill in the art.

SUMMARY

The present disclosure provides an adapter device for test, a terminal test system and a test method.

Other features and advantages of the present disclosure will become apparent from the following detailed description, or in part, from practice of the present disclosure.

According to one aspect of the present disclosure, there is provided an adapter device for test comprising:

an adapter board having a voltage input terminal connected to an external power supply and an output terminal connected to a terminal to be tested;

a voltage conversion circuit disposed on the adapter board and connected to the voltage input terminal and configured to convert the voltage of the external power supply received at the voltage input terminal into a test voltage to be supplied to the terminal to be tested:

a feedback circuit connected to the voltage conversion circuit and configured to compare the test voltage with a reference voltage to provide feedback data; and a compensation circuit connected to the feedback circuit and the adapter board, and configured to generate a compensation voltage based on the feedback data and apply the compensation voltage to the adapter board to compensate for the test voltage.

In an exemplary embodiment of the present disclosure, the feedback circuit comprises:

an error amplifier having a first input terminal to receive the test voltage, a second input terminal to receive the reference voltage, and an output terminal connected to the compensation circuit.

In an exemplary embodiment of the present disclosure, the compensation circuit is connected to the feedback circuit and the voltage input terminal of the adapter board, and configured to apply the generated compensation voltage to the voltage input terminal.

In an exemplary embodiment of the present disclosure, the compensation circuit is connected to the feedback circuit and the voltage output terminal of the adapter board, and configured to apply the generated compensation voltage to the voltage input terminal.

In an exemplary embodiment of the present disclosure, the functions of the feedback circuit and the compensation circuit are integrated into a voltage feedback circuit chip.

In an exemplary embodiment of the present disclosure, the adapter device further comprises:

a sampling circuit connected between the voltage conversion circuit and the voltage feedback circuit chip, and configured to sample the test voltage and input the sampled signal to the voltage feedback circuit chip.

In an exemplary embodiment of the present disclosure, the sampling circuit comprises:

a first voltage dividing resistor having one end connected to the voltage conversion circuit and the other end connected to a feedback voltage input terminal of the voltage feedback circuit chip; and a second voltage dividing resistor having one end connected to the first voltage dividing resistor and the other end grounded.

According to one aspect of the present disclosure, there is provided a terminal test system comprising the adapter device described above.

According to one aspect of the present disclosure, there is provided a terminal test method, for providing a stable test voltage when a load applied on the terminal changes. The terminal test method comprises:

receiving a voltage of an external power supply and convert the voltage to a test voltage;

comparing the test voltage with a reference voltage to provide feedback data; and generating a compensation voltage based on the feedback data to compensate for the test voltage.

In an exemplary embodiment of the present disclosure, comparing the test voltage with a reference voltage to provide feedback data comprises:

inputting the test voltage and the reference voltage to an error amplifier for comparison, and outputs the feedback data.

It is to be understood that both the foregoing general description and the following detailed description are exemplary and explanatory only and do not limit the disclosure.

BRIEF DESCRIPTION OF THE DRAWINGS

The drawings herein are incorporated into and constitute a part of this specification, illustrating embodiments consistent with the present disclosure and, together with the description, serve to explain the principles of the present disclosure. It will be apparent that the drawings described below are merely examples of the present disclosure and that other drawings may be obtained by those skilled in the art from these drawings without paying inventive work.

DETAILED DESCRIPTION

Figure 1:
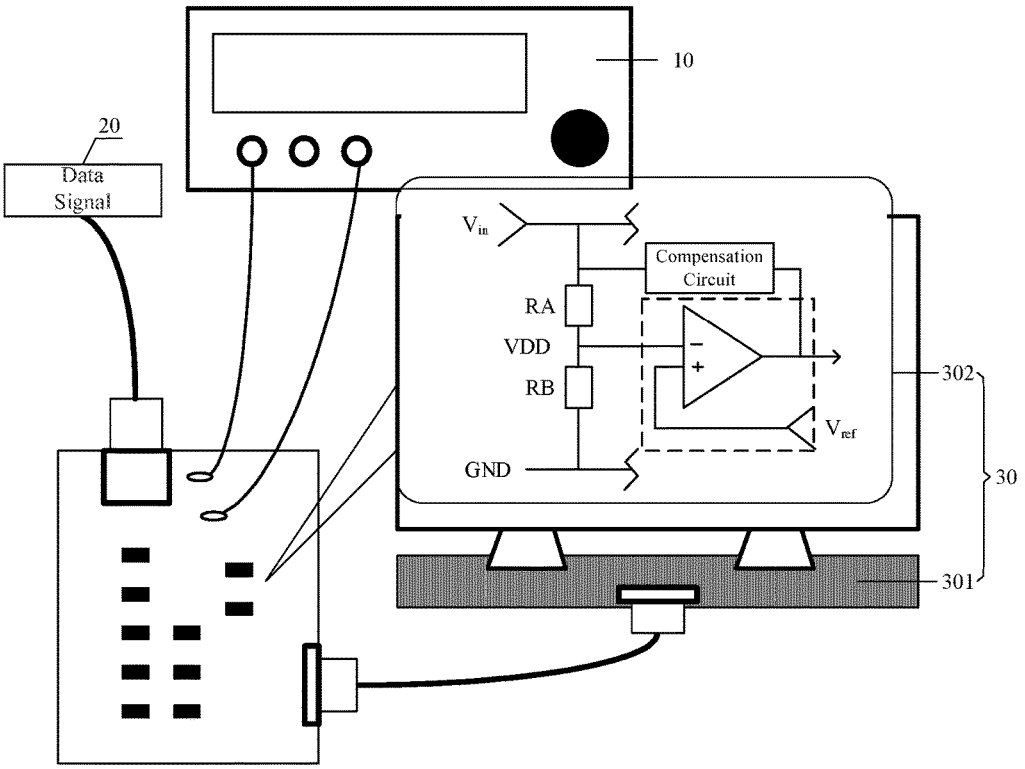
FIG. 1 schematically illustrates an architecture diagram of a screen lighting test system according to an exemplary embodiment of the present disclosure.

Now exemplary embodiments will be described more fully with reference to the accompanying drawings. However, the exemplary embodiments may be practiced in many forms and should not be construed as limited to the examples set forth herein. Rather, the provision of such embodiments makes the present disclosure more thorough and complete, and may fully convey the concepts of the exemplary embodiments to those skilled in the art. The features, structures, or characteristics described may be combined in one or more embodiments in any suitable manner.

In addition, the drawings are merely illustrative of the present disclosure and are not necessarily drawn to scale. The same reference numerals in the drawings denote the same or similar parts, and thus repeated description thereof will be omitted. Some of the block diagrams shown in the figures are functional entities that do not necessarily correspond to physical or logically independent entities. These functional entities may be implemented in software form, or may be implemented in one or more hardware devices or integrated circuits, or implemented in different networks and or processor devices and or microcontrollers.

The present exemplary embodiment provides an adapter device for test, which may be applied to a terminal test system such as a screen lighting test system. As shown in FIG. 1, in the terminal test system, the adapter device has an input terminal connected to an external power supply 10, another input terminal connected to a data signal terminal 20, and an output terminal connected to a terminal to be tested, for example, a display device 30. The adapter device is configured to convert the voltage of the external power supply to a test voltage VDD, and convert a data signal into a signal of a displayed frame, for example, and supplied the test voltage VDD and the signal of a displayed frame to a PCB 301 of the terminal (for example the display device 30) to be tested through the adapter cable, such that the display screen 302 displays the frame.

Figure 2:
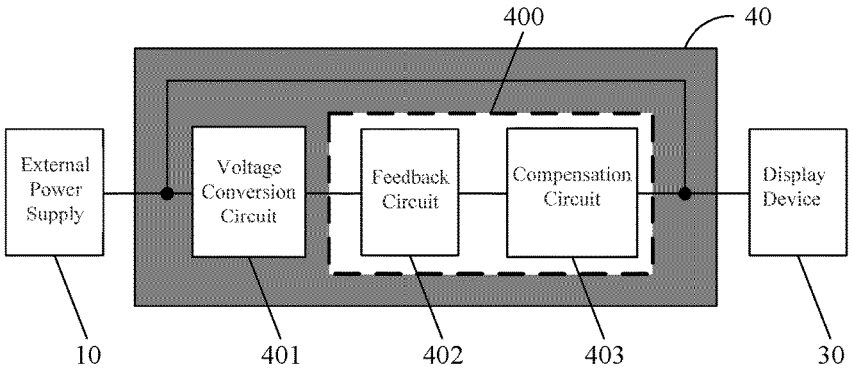
FIG. 2 schematically illustrates a first schematic diagram of a connection relationship of an adapter device for screen lighting test according to an exemplary embodiment of the present disclosure.
Figure 3:
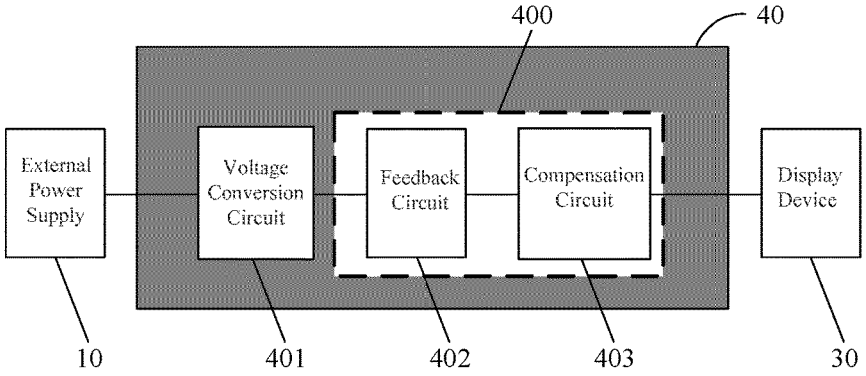
FIG. 3 schematically illustrates a second schematic diagram of a connection relationship of an adapter device for screen lighting test according to an exemplary embodiment of the present disclosure.

Based on this, as shown in FIGS. 2 and 3, the adapter device may include an adapter board 40, a voltage conversion circuit 401, a signal conversion circuit (not shown in the figures), a feedback circuit 402 and a compensation circuit 403.

The adapter board 40 has a voltage input terminal connected to an external power supply 10, a data input terminal connected to a data signal terminal 20, and an Output terminal connected to a terminal to be tested, such as the display device 30.

The voltage conversion circuit 401 is disposed on the adapter board 40 and connected to the voltage input terminal for converting the voltage of the external power supply received at the voltage input terminal into the test voltage VDD to be supplied to the terminal to be tested, for example, the display device 30.

The signal conversion circuit is disposed on the adapter board 40 and connected to the data input terminal for converting the data signal received at the data input terminal into, for example, a displayed frame signal.

The feedback circuit 402 is connected to the voltage conversion circuit 401 for comparing the test voltage VDD with a reference voltage Vref to provide feedback data.

The compensation circuit 403 is connected to the feedback circuit 402 and the adapter board 40 for generating a compensation voltage based on the feedback data and applying the compensation voltage to the adapter board 40 to compensate for the test voltage VDD.

The test voltage VDD refers to, during the terminal test, a logic input voltage actually provided by the adapter device to the PCB of the terminal to be tested, for example the display device 30. The reference voltage Vref refers to, during the terminal test, in theory, a logic input voltage should be provided by the adapter device to the PCB of the terminal to be tested, for example the display device 30.

It should be noted that the voltage conversion circuit 401, the signal conversion circuit, the feedback circuit 402 and the compensation circuit 403 may be disposed on the adapter board 40. That is, the adapter board 40 integrates functions of voltage conversion, signal conversion, data feedback, and data compensation. However, the feedback circuit 402 and the compensation circuit 403 may be provided separately from the adapter board 40, which is not specifically limited thereto. In addition, since the core of the present exemplary embodiment is the feedback compensation of the voltage, the part relating to the signal conversion circuit will not be described in detail, and it may be regarded as the same as the related art.

The adapter device for test provided by the exemplary embodiment of the present disclosure is additionally provided with a feedback compensation function on the basis of the function of the conventional adapter board. By comparing the test voltage VDD generated by the voltage conversion circuit with the reference voltage Vref to obtain a compensation Voltage, thus achieving the compensation of the test voltage VDD. During the terminal test, there may be a change in the load applied on the terminal due to, for example, display frame switching, which causes a change in the test voltage VDD. The present disclosure compensates the test voltage VDD with the functions of the feedback circuit and the compensation circuit. The test voltage VDD may be kept at the same value at the time of load applied on the terminal change, due to such as switching of displayed frames. Thus, it may avoid the need to manually adjust the external supply voltage, providing convenience for the electrical analysis of the terminal product.

It may be seen that the adapter device provided by the present exemplary embodiment corresponds to a power supply assisting structure which may automatically adjust the logic input voltage of the terminal product to keep it stable under different loads applied on the terminal.

Figure 4:
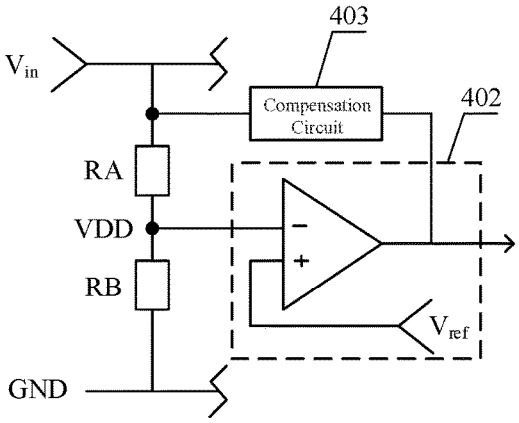
FIG. 4 schematically illustrates a first equivalent circuit diagram of a screen lighting test system according to an exemplary embodiment of the present disclosure.
Figure 5:
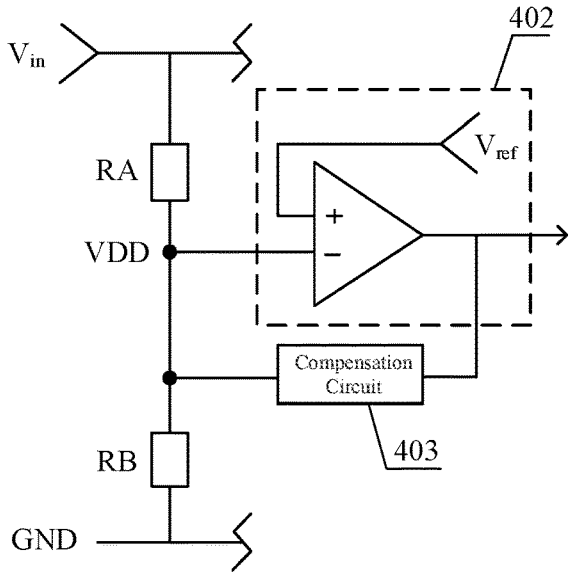
FIG. 5 schematically illustrates a second equivalent circuit diagram of a screen lighting test system according to an exemplary embodiment of the present disclosure.

In the exemplary embodiment, as shown in FIGS. 4 and 5, the feedback circuit 402 may include an error amplifier. The error amplifier has a first input terminal to receive the test voltage VDD, a second input terminal to receive the reference voltage Vref, and an output terminal connected to the compensation circuit 403. In this way, by comparing and amplifying the difference between the test voltage VDD and the reference voltage Vref, accurate feedback data may be obtained, thereby improving the accuracy of the compensation voltage.

In the present exemplary embodiment, the compensation for the test voltage VDD may specifically include the following two implementations.

First implementation. Referring to FIGS. 2 and 4, the compensation circuit 403 is connected to the feedback circuit 402 and the voltage input terminal of the adapter board 40 for applying the generated compensation voltage to the voltage input terminal.

In this compensation implementation, the compensation voltage is applied to the voltage input terminal of the adapter board 40. Then, the compensated voltage passes through the traces and components on the adapter board 40 and will generate a certain voltage drop. As a result, as long as the feedback voltage received by the feedback circuit 402 is not equal to the reference voltage Vref, the feedback and the voltage compensation will be continuously compared until the test voltage VDD is exactly equal to the reference voltage Vref, and then the automatic adjustment of the test voltage VDD when the load applied on the terminal changes will be completed. The present exemplary embodiment fully takes into account the voltage drop caused by the impedance of the traces and components of the adapter board 40. Therefore, the feedback compensation of the voltage is also the compensation value Obtained by calculating the impedance of the traces and components of the adapter board 40, to offset the voltage drop generated by the adapter board 40.

Second implementation. Referring to FIGS. 3 and 5, the compensation circuit 403 is connected to the feedback circuit 402 and the output terminal of the adapter board 40 for applying the generated compensation voltage to the output terminal.

In this compensation implementation, the compensation voltage is to apply to the output terminal of the adapter board 40, regardless of the impedance of the traces and components of the adapter board 40. The compensated voltage is outputted directly to the terminal to be tested, for example, the display device 30, via the adapter cable.

Based on the above second implementation, simplifying of the modification of the adapter board 40 is considered. Referring to FIGS. 2 and 3, the present exemplary embodiment integrates the functions of the feedback circuit 402 and the compensation circuit 403 into a voltage feedback circuit chip 400. In this way, not only the structural modification of the adapter board 40 per se may be simplified, but also the existing circuit chip may be utilized to implement the voltage feedback compensation function, which provides a convenient condition for the implementation of the present disclosure.

It is to be noted that when the feedback compensation function of the adapter device is realized by the voltage feedback circuit chip 400, a corresponding peripheral connection circuit is provided between the circuit chip and other functional circuits of the adapter board 40. The peripheral connection circuit is not specifically limited, as long as the feedback compensation function of the circuit chip may be realized.

Below, referring to an equivalent circuit diagram of the terminal test system as shown in FIG. 4, assuming that the terminal test system is a screen lighting test system for example, the adapter device for test in the exemplary embodiment will be specifically described.

$V_{in}$ refers to the voltage received at the voltage input terminal of the adapter board 40. RA refers to the impedance of the traces and components on the adapter board 40. RB refers to the impedance of the display screen 302 and the PCB 301. The load RB will vary with the load applied on the terminal, that is, vary with the switching of the displayed frame.

During the screen lighting test, the external power supply 10 supplies a supply voltage to the adapter board 40 and the power supply voltage is equal to the logic input voltage that theoretically should be provided for the display device 30. At this time the voltage input terminal of the adapter board 40 receives a voltage $V_{in}$. The voltage $V_{in}$ is converted to the test voltage VDD through the voltage conversion circuit 401 on the adapter board 40 for output. On this basis, when the displayed frame is switched, the load RB of the display screen will change, and the test voltage VDD will also change. At this time, the test voltage VDD and the reference voltage Vref are respectively connected to the positive and negative terminals of the error amplifier, and the magnitude of the reference voltage Vref is set to the logic input voltage to be theoretically provided for the display device 30. When the test voltage VDD is not equal to the reference voltage Vref, the difference between them is amplified by the error amplifier and feedback data is supplied to the compensation circuit 403. The compensation circuit 403 generates a compensation voltage to be applied to the voltage input terminal of the adapter board 40 based on the feedback data. The error amplification and feedback compensation is continued until the test voltage VDD equals to the reference voltage Vref, thereby achieving automatic adjustment of the test voltage VDD when the displayed frame is switched. Thus, it may ensure the consistency of the logic input voltage provided to the display device 30 when different frames are displayed.

Similarly, referring to FIG. 5, when the compensation voltage is applied to the output terminal of the adapter board 40, the processes of the conversion of the test voltage VDD, the supply of the feedback data, and the generation of the compensation voltage are similar to the above processes (except that the positions for application of the compensation voltage are different), which will not be repeated herein.

Figure 6:
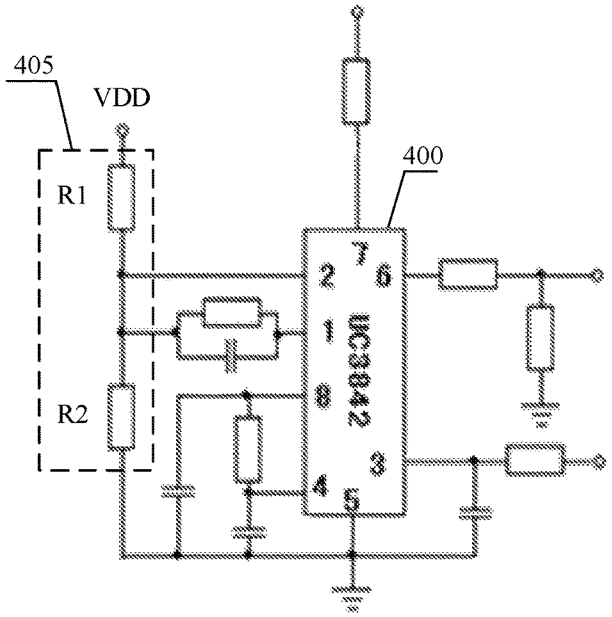
FIG. 6 schematically illustrates a schematic diagram of a design of a UC3842 chip mounted on an adapter board according to an exemplary embodiment of the present disclosure.

In the present exemplary embodiment, as shown in FIG. 6, the adapter device may further include a sampling circuit 405 connected between the voltage conversion circuit 401 and the voltage feedback circuit chip 400 for sampling the test voltage VDD and inputting the sampled signal to the voltage feedback circuit chip 400. The sampling circuit 405 may include a first voltage dividing resistor R1 having one end connected to the voltage conversion circuit 401 and the other end connected to a feedback voltage input terminal of the voltage feedback circuit chip 400, and a second voltage dividing resistor R2 having one end connected to the first voltage dividing resistor R1 and the other end grounded.

It should be noted that, FIG. 6 illustrates an example in which the UC3842 chip is mounted on the adapter board 40 and a peripheral circuit is provided. However, in the present embodiment, other type of chip may be mounted as long as the chip has the electrical feedback compensation function.

Specifically, UC3842 chip has a fixed operating frequency, and controllable pulse width modulation. The internal reference circuit in the UC3842 chip may generate a reference voltage of +5 V as the internal power supply of the UC3842. The reference voltage is attenuated to +2.5V voltage as the reference voltage Vref of the error amplifier to be inputted to the positive input terminal of the error amplifier. The voltage conversion circuit 401 divides the converted test voltage VDD by the voltage dividing resistors R1 and R2 to obtain a voltage sampling signal. The sampling signal is connected to a negative input terminal of the error amplifier via a voltage feedback input terminal (pin 2) of the PWM (Pulse Width Modulation) controller inside the chip. When the sampling voltage is less than 2.5V, the difference between the positive input terminal and the negative input terminal of the error amplifier is amplified to generate a compensation voltage applied to the voltage input terminal of the adapter board 40. The test voltage VDD rises after continued feedback compensation, and eventually stabilizes at the preset voltage.

It is to be noted that in the present embodiment a voltage feedback circuit chip is mounted on the adapter board 40, and the voltage at the output terminal of the adapter board is directly adjusted according to feedback. Therefore, the impedance of the traces and components of the adapter board 40 is not calculated. However, since the reference voltage Vref is a preset value inside the chip and the voltage dividing resistors for voltage sampling have fixed resistances, the output voltage obtained corresponds to a fixed value. In the present embodiment, it may also be set to a commonly used logic input voltage 3.3V. The limitation is that if other logic voltage input value is needed, the voltage dividing resistors will have to be replaced manually.

The present exemplary embodiment also provides a terminal test system which, as shown in FIG. 1, includes the above-described test adapter device. By way of example, the terminal test system may be a screen lighting test system. The test adapter device integrates functions of voltage conversion, data transmission, and automatic adjustment of the test voltage.

Figure 7:
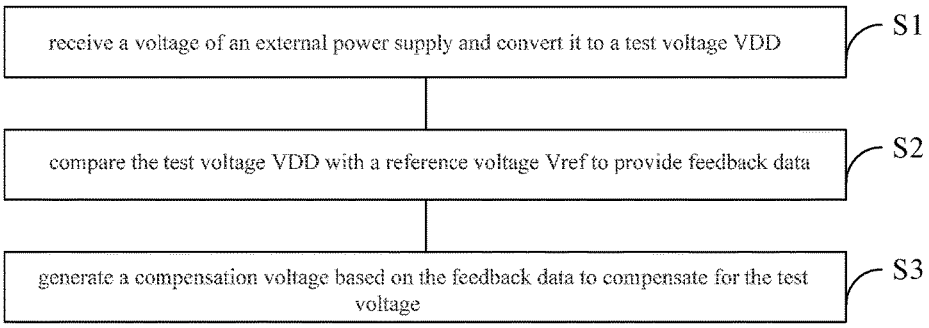
FIG. 7 schematically illustrates a flow chart of a screen lighting test method according to an exemplary embodiment of the present disclosure.

It should be noted that the specific details of the terminal test system have been described in detail in the corresponding adapter device for test, and will not be repeated herein, The present exemplary embodiment also provides a terminal test method such as a screen lighting test method, for providing a stable test voltage when the load applied on the terminal changes due to, for example, switching of displayed frames. As shown in FIG. 7, the terminal test method may include the following steps.

At a step of S1, a voltage of an external power supply is received and converted to a test voltage VDD.

At a step of S2, the test voltage VDD is compared with a reference voltage Vref to provide feedback data.

Specifically, the feedback circuit 402 inputs the test voltage VDD and the reference voltage Vref to the positive and negative terminals of the error amplifier for comparison, and outputs feedback data to the compensation circuit 403 based on the comparison result.

At a step of S3, a compensation voltage is generated based on the feedback data to compensate for the test voltage.

Specifically, the compensation circuit 403 generates a compensation voltage based on the feedback data and applies it to the voltage input terminal of the adapter board 40 or to the output terminal of the adapter board 40 to compensate for the test voltage VDD.

In the terminal test method provided by the exemplary embodiment of the present disclosure, by comparing the test voltage VDD generated by the voltage conversion circuit with the reference voltage Vref to obtain a compensation voltage, thus achieving the compensation of the test voltage. During the terminal test, there may be a change in the load applied on the terminal due to, for example, display frame switching, which causes a change in the test voltage. The present disclosure compensates the test voltage VDD with the feedback compensation function. The test voltage VDD may be kept at the same value at the time when the load applied on the terminal changes, due to such as switching of displayed frames. Thus, it may avoid the need to manually adjust the external supply voltage, providing convenience for the electrical analysis of the terminal product.

It should be noted that although several devices or circuits of the device for action execution are mentioned in the above detailed description, such division is not mandatory. In fact, according to embodiments of the present disclosure, the features and functions of two or more devices or circuits described above may be embodied in a device or circuit. Conversely, the features and functions of a device or circuit described above may be further subdivided into a plurality of devices or circuits.

In addition, although the various steps of the method of the present disclosure have been described in a specific order in the drawings, it is not intended or implied that the steps must be performed in that particular order or the steps shown must be performed to achieve the desired result. Additional or additionally, some steps may be omitted, multiple steps may be combined into one step, and/or a step may be decomposed into multiple steps It will be readily understood by those skilled in the art from the description of the above embodiments that the exemplary embodiments described herein may be implemented by software or by means of software in conjunction with the necessary hardware. Thus, the technical solution according to the embodiments of the present disclosure may be embodied in the form of a software product which may be stored on a nonvolatile storage medium (which may be a CD-ROM, a U disk, a mobile hard disk, etc.) or on a network, which includes a number of instructions to enable a computing device (which may be a personal computer, a server, a mobile terminal, or a network device, etc.) to perform a method according to the embodiments of the present disclosure.

Other embodiments of the present disclosure will be readily apparent to those skilled in the art upon consideration of the specification and practice of the present disclosure disclosed herein. This application is intended to cover any variations, usages, or adaptations of the present disclosure that follow the general principles of the present disclosure and include the common general knowledge or conventional techniques disclosed in this disclosure without departing from the present disclosure. The specification and examples are to be regarded as illustrative only, and the true scope and spirit of the disclosure is specified by the appended claims.

What is claimed is:

1. An adapter device for test, comprising:

an adapter board having a voltage input terminal connected to an external power supply and an output terminal connected to a terminal to be tested;

a voltage conversion circuit disposed on the adapter board and connected to the voltage input terminal and configured to convert a voltage of the external power supply received at the voltage input terminal into a test voltage to be supplied to the terminal to be tested;

a feedback circuit connected to the voltage conversion circuit and configured to compare the test voltage with a reference voltage to provide feedback data;

a compensation circuit connected to the feedback circuit and the adapter board, and configured to generate a compensation voltage based on the feedback data and to apply the compensation voltage to the adapter board to compensate for the test voltage;

a sampling circuit connected between the voltage conversion circuit and the voltage feedback circuit chip, and configured to sample the test voltage and to input sampled signals to the voltage feedback circuit chip, wherein the compensation circuit is connected to the feedback circuit and the voltage output terminal of the adapter board, and configured to apply the generated compensation voltage to the voltage input terminal, wherein the feedback circuit and the compensation circuit are integrated into a voltage feedback circuit chip, wherein the sampling circuit comprises:

a first voltage dividing resistor having one end connected to the voltage conversion circuit and the other end connected to a feedback voltage input terminal of the voltage feedback circuit chip; and a second voltage dividing resistor having one end connected to the first voltage dividing resistor and the other end grounded.

2. The adapter device according to claim 1, wherein the feedback circuit comprises:

an error amplifier having a first input terminal to receive the test voltage, a second input terminal to receive the reference voltage, and an output terminal connected to the compensation circuit.

3. The adapter device according to claim 1, wherein the compensation circuit is connected to the feedback circuit and the voltage input terminal of the adapter board, and configured to apply the generated compensation voltage to the voltage input terminal.

4. The adapter device according to claim 2, wherein the compensation circuit is connected to the feedback circuit and the voltage input terminal of the adapter board, and configured to apply the generated compensation voltage to the voltage input terminal.

5. A terminal test system comprising the adapter device for test according to claim 1.

6. A terminal test method, for providing a stable test voltage when a load applied on the terminal changes, and the terminal test method comprising:

receiving, by an adapter board, a voltage of an external power supply and converting, by a voltage conversion circuit, the voltage to a test voltage;

sampling, by a sampling circuit, the test voltage;

comparing, by a feedback circuit, the sampled test voltage with a reference voltage to provide feedback data; and generating, by a compensation circuit a compensation voltage based on the feedback data to compensate for the test voltage, wherein the compensation circuit is connected to the feedback circuit and a voltage output terminal of the adapter board, and configured to apply the generated compensation voltage to a voltage input terminal of the adapter board, wherein the feedback circuit and the compensation circuit are integrated into a voltage feedback circuit chip, wherein the sampling circuit comprises:

a first voltage dividing resistor having one end connected to the voltage conversion circuit and the other end connected to a feedback voltage input terminal of the voltage feedback circuit chip; and a second voltage dividing resistor having one end connected to the first voltage dividing resistor and the other end grounded.

7. The terminal test method according to claim 6, wherein the step of comparing the sampled test voltage with a reference voltage to provide feedback data comprises:

inputting the test voltage and the reference voltage to an error amplifier for comparison, and outputs the feedback data.

* * * * *